US005316085A

United States Patent [19]

Dawson

[11] Patent Number: 5,316,085

[45] Date of Patent: May 31, 1994

[54] ENVIRONMENTAL RECOVERY SYSTEM

[75] Inventor: William C. Dawson, Baton Rouge, La.

[73] Assignee: Exxon Research and Engineering Company, Florham Park, N.J.

[21] Appl. No.: 869,289

[22] Filed: Apr. 15, 1992

[51] Int. Cl.[5] ..... E21B 43/00

[52] U.S. Cl. ..... 166/369; 166/53; 166/66; 166/68; 166/72

[58] Field of Search ..... 166/53, 66, 72, 105, 166/365, 269, 105.3

[56] References Cited

U.S. PATENT DOCUMENTS

| | | | |
|---|---|---|---|
| 288,446 | 11/1883 | Karns | 166/72 |
| 3,922,116 | 11/1975 | Pugh | 417/393 |
| 3,965,983 | 6/1976 | Watson | 166/369 |
| 4,042,025 | 8/1977 | Skinner et al. | 166/53 |
| 4,541,274 | 9/1985 | Purcupile | 166/105 |
| 4,625,807 | 12/1986 | Harlow | 166/53 |
| 4,727,936 | 3/1988 | Mioduszewski et al. | 166/53 |
| 4,747,451 | 5/1988 | Adams, Jr. et al. | 166/53 |
| 4,934,458 | 6/1990 | Warburton et al. | 166/53 |
| 5,028,212 | 7/1991 | Biophey et al. | 166/66 |
| 5,049,037 | 9/1991 | Carson et al. | 166/53 |

*Primary Examiner*—Ramon S. Britts
*Assistant Examiner*—Frank S. Tsay
*Attorney, Agent, or Firm*—Henry E. Naylor

[57] ABSTRACT

A system for recovering subterranean fluids from a site contaminated by hazardous waste is disclosed. The system for recovering the fluids in a wellbore comprises pump unit means for pumping the subterranean fluid from the wellbore, liquid level sensing means for sensing the liquid level within the wellbore, and activation means for activating the pumping unit means in response to the fluid level sensing means. The system may also include microprocessor means for storing and interpreting the data from the sensing means.

20 Claims, 4 Drawing Sheets

ENVIRONMENTAL RECOVERY SYSTEM

BACKGROUND OF THE INVENTION

This invention relates to an environmental recovery system. More particularly, but not by way of limitation, this invention relates to a system for recovering subterranean liquids from a site contaminated by hazardous waste.

During the course of industrial activities, such as petrochemical operations, certain hazardous materials are discharged unintentionally into the environment. As those of ordinary skill in the art will appreciate, these materials can ultimately contaminate the site above which the industry is situated. Furthermore, these materials can penetrate the ground soil and enter into the underlying water aquifers.

As a result, both state and federal regulatory agencies have promulgated hazardous waste clean-up programs. One of the approved methods is the extraction of the contaminated soil. Another approved process is the recovery of the insitu contaminated water through the use of recovery wells which is referred to as "pump and treat".

In the retrieval of underground water by using the recovery well process, one of the concerns is the preservation of a hydraulic gradient across the waste site which will contain the contaminated liquids in the immediate area of the recovery site. Another concern is the removal of source contaminates such as nonaqueous phase liquids (NAPL).

At the outset, it should be noted that many underground reservoirs will be shallow, and highly permeable. Thus, at the recovery site, by extracting the subterranean fluids, the hydraulic gradient in that area is lowered thereby precluding the contaminated water's migration to other uncontaminated area's. Therefore, underground water from uncontaminated areas is flowing into the site area rather than flowing out of the site area.

Various systems have been designed in order to extract the contaminated groundwater and non-aqueous phase liquids. One of the systems is the use of pumping units typically found in oil and gas fields when the hydrocarbon reservoir has ceased flowing and artificial means of producing the oil is required.

The artificial lift pumping unit utilized in the oil and gas industry comprises of a downhole pump located in a wellbore. The downhole pump is actuated by means of a string of sucker rods which extends to the surface. The sucker rod is attached to polished rod which is moved up and down by a surface pumping unit. A pumping unit is a mechanism which imparts reciprocating motion to a polished rod.

In normal oil well applications, the pump piston would be actuated by an electric motor connected to a "walking beam" arrangement. In the environmental area, the rate of groundwater recovery is generally much slower and more volatile than oil well flows; therefore, this method of actuation would be very inefficient. Flow rates from recovery wells can be as low as 0.001 gallons per minute, but can vary greatly depending on influencing conditions (e.g. local rainfall, or recharging from high levels on nearby rivers and streams, or the permeability and porosity of the reservoir, etc). Also, the size of the contaminated site may vary from several acres to several hundred acres. At the larger recovery sites, this may mean having 200 to 500 hundred pumping units.

If a conventional electric actuator was used under these conditions to maintain the recover well level below a certain point, then either the motor would be starting and stopping very frequently or the pump piston would be pumping dry. Neither of the above conditions are desirable.

Further, there is no teaching in the prior art of a system that checks whether in fact the system is pumping any of the contaminated fluid. As noted earlier, the significant amount of government regulation in this area makes having a system of checks and balances imperative. Also, the prior art does not teach, disclose nor suggest a system to insure that the proper hydraulic gradient is being maintained at the recovery site.

Therefore, there is a need for a system that will continuously monitor recovery wells and insure that the site is maintaining the proper pressure gradient in the aquifer in order to maintain the hydraulic containment. There is also a need for an apparatus which will activate only when fluid is in the wellbore thus eliminating the pump pumping dry. A system is also needed which will provide for the proper system of checks and balances for the appropriate government agency.

SUMMARY OF THE INVENTION

The present invention includes both apparatus and method claims for an environmental recovery system. The apparatus for recovering underground liquids in a wellbore comprises a pumping unit means for pumping the underground liquids from the wellbore. A liquid level sensing means for sensing the liquid level within the wellbore is also provided. An actuator means for activating the pumping unit in response to the liquid level sensing means is also included.

In one embodiment, the pumping unit means includes a downhole pump, a sucker rod attached to the pump, a polished rod threadedly connected to the sucker rod, a surface pumping unit which is connected to the polished rod so that the pumping unit imparts reciprocating motion to the sucker rod. Also included will be pneumatic actuator means, which is operatively connected to the pumping unit, for actuating the reciprocating movement of the pumping unit.

The liquid level sensing means may contain a bubbler tube and stroke pump level switch means. The bubbler tube is sensitive to the hydrostatic pressure within the wellbore so that as the liquid level rises to a predetermined level within the wellbore, the change in the hydrostatic pressure is effected in the bubbler tube. The level switch means, which is operatively connected to the bubbler tube, is used for determining when a threshold pressure within the wellbore has been surpassed and then converting the pressure to an electrical signal.

The apparatus can also contain a high level switch means, which also will be connected to the bubbler tube for generating a signal once a pre-determined threshold hydrostatic pressure, which corresponds to a high fluid level within the wellbore, has been exceeded.

The actuator means will comprise: a programmable processing means for processing the stroke pump level switch means, said programmable processing means including storage means for storing the digital signals, interpreting means for interrupting the signals from the stroke pump level switch means, and generating means for generating an output signal; and a solenoid valve, connected to the pumping unit, so that the solenoid valve is responsive to the output signal of the processing means.

The invention also contains a method of recovering subterranean fluids from a wellbore utilizing a pumping unit, wherein the method includes flowing the fluids into the wellbore, sensing the level of the fluid in the wellbore, and generating a pressure signal in response to a fluid level in the wellbore. Next, the pressure signal is stored in a programmable processing means, and then the processing means determines when the pressure signal surpasses a predetermined threshold pressure, and then activating the pumping unit to cause the fluid to be pumped from the wellbore.

The method disclosed can also comprise the steps of deactivating the pumping unit after draining the wellbore of fluid, and repeating the steps heretofore described as many times as necessary in order to drain the underground aquifer of the contaminated liquids.

The disclosed method may also include, after the step wherein the pressure has been determined to surpass a predetermined threshold, determining when the pressure signal surpasses a second predetermined threshold pressure level which corresponds to a high fluid level in the wellbore, and then activating an alarm in order to warn a operator of the high fluid level.

Also, the step wherein it was determined that the pressure level surpassed a predetermined threshold will also include presetting in the programmable processor means a time period which corresponds to a normal discharge cycle, and then comparing the present time for the wellbore to fill with the preset time, and then activating the pumping unit once the time period from the prior activation of the pumping unit exceeds the preset time to cause the pumping unit to pump the fluid from the wellbore.

A feature of the present invention is the use of a pneumatically actuated pumping unit. Another feature is the use of a sensing means for sensing the level of fluid in the wellbore. Still another feature includes the use of a programmable processing means which can store, and compare the data being generated by the sensing means. Yet another feature of the invention includes the processor means interpreting the data and generating a signal to activate the pumping unit.

Another feature of the invention includes the use of a high level sensing means to sense a high fluid level in the wellbore in order to notify the operator. Another feature includes the use of a flow switch to determine the rate and quantity of fluid produced. Yet another feature includes the discharge timer which will time the stroke of the pump. Still another feature includes the fill timer which will cause the pump to stroke if after a period of time the stroke pump switch has not activated.

An advantage of the present invention is the accessibility of all the data through the processor means which will assure the proper pump displacement of the fluids in the wellbore, and will provide for real time display of the entire recovery system thus assuring the operator the recovery wells are being maintained below a certain point in order to preserve the hydraulic gradient. Another advantage includes the use of a pneumatic actuator, rather than an electrical actuator, which is more cost effective. Yet another advantage is the inherent safety benefits of using air versus electricity.

DESCRIPTION OF THE PREFERRED EMBODIMENTS

Figure 1:
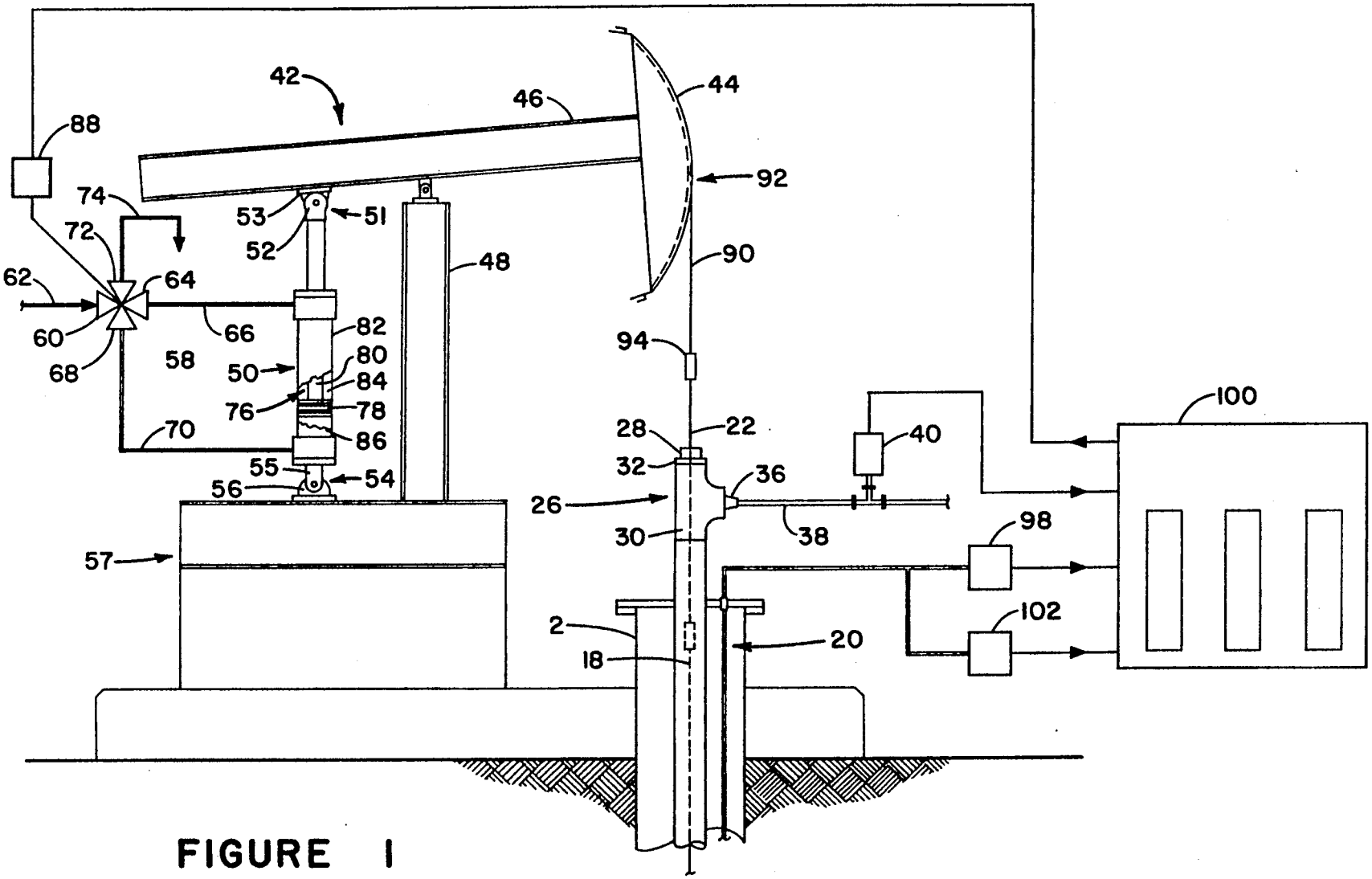
FIG. 1 is a schematic view of a wellbore with a downhole pump in place.
Figure 2:
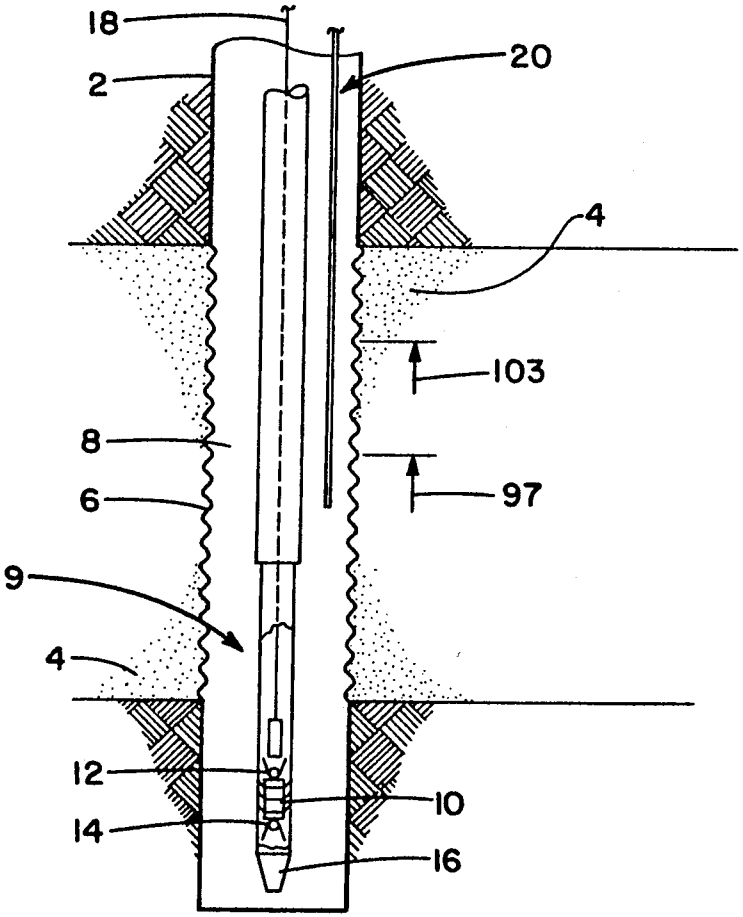
FIG. 2 is a schematic view of the pumping unit situated in place over the wellhead.

Referring to FIGS. 1 and 2, a typical wellbore 2 penetrating a contaminated subterranean formation 4 is shown. The wellbore 2 is generally a cylindrical metal casing. The wellbore will have attached thereto at one end a screen 6 which will allow for the flow of fluids from the formation 4 into the annulus area 8, but will preclude any of the sand from entering the wellbore and thereby plugging the annulus 8.

The downhole pump, seen generally at 9, will include a piston 10, a top check valve 12 and bottom check valve 14. Adapted to the lower portion of the downhole pump is the suction strainer 16.

The downhole pump 9 will be threadedly attached to the sucker rod string 18 which extends to the surface. Also disposed within the wellbore 2, will be the sensing means 20, which in the preferred embodiment is a ¼" bubbler tube. The bubbler tube will be able to sense the hydrostatic pressure within the wellbore. The bubbler tube can be purchased from any pipe and fitting supplier. Thus, as the fluid level rises within the wellbore 2, the sensing means can determine the height of the fluid column.

Referring to FIG. 1, the upper end of the rod string 18 is attached to a polished rod 22 which is moved up and down by the pumping unit 24. The wellbore terminates at the surface production tee and packing gland, seen generally at 26. The stuffing box assembly 28 will have sealingly engaged therein the aforementioned polish rod 22. Attached to the stuffing box 28 will be the tee fitting 30, and separating the tee fitting 30 and stuffing box 28 will be the reducing bushing 32.

The tee fitting 30 will have an exit passageway 34 which will have disposed therein a reducer 36, and coupled thereto a flow line 38 for conveying the produced fluids from the underground formation. The flow line 38 will have included thereon a flow switch 40 for measuring the flow from the well bore in order to determine the rate of production as well as the quantity of fluid produced. The flow switch is a paddle type discrete switch commercially available and can be purchased from any commercial instrument supplier.

Referring to FIG. 1, the pumping unit means is seen generally at 42. The pumping unit will comprise a horsehead 44, a walking beam 46, and post 48. The pumping unit, in the preferred embodiment, will also include a pneumatic actuator 50 which has a first end 51 which comprises of a rod clevis 52 which is connected to a eye bracket 53 on the walking beam 46. The second end 54 will contain rear clevis 55 attached to an eye bracket 56 on the pump assembly base 57.

The pumping unit 42 will also have associated therewith pneumatic actuator means, which comprises a 4-way pneumatic controller valve 58, which in turn has first side 60 connected to an air pressure supply line 62, second side 64 connected to the air input line 66, third side 68 connected to air input line 70, and fourth side 72 connected to vent line 74. The air pressure supply line 62 will be connected to a air pressure source, not shown, such as a air compressor.

As shown in FIG. 2, sides 60 and 64 are in phase with each other, and sides 68 and 72 are in phase with one another so that when side 60 is in communication with the air pressure source, the high pressure will be communicated to the pneumatic actuator 50 via side 64 and air input line 66. At the same time, vent line 74 will be aligned with the side 72 and air in the pneumatic actuator will be allowed to vent via side 68 and air input line 70. However, if the valve 58 is shifted, then side 72 becomes aligned with the high pressure source and high pressure gas is feed into line 70 via side 68, with side 60 and line 66 being vented to the atmosphere. Generally, while the pumping unit means 42 is waiting to stroke, air pressure from line 62 is in communication with air input line 70.

The pneumatic actuator will have disposed therein a power piston means 76 which comprises a piston 78 and shaft member 80. The piston 78 is disposed within cylinder 82 such that a first chamber 84 and a second chamber 86 are formed therein. The air input line 66 is connected to the first chamber 84 and the air input line 70 is connected to the second chamber 86.

Operably associated with the 4-way valve 68 is solenoid valve 88. Solenoid valve is controlled, or actuated by, the programmable logic controller 100 (hereinafter referred to as the "PLC"), which will be discussed later in greater detail. Solenoid valve 88 will be signaled by the controller 100; this signal will then cause the solenoid valve to switch the 4-way valve 68.

Thus, in the position seen in the FIG. 1, air pressure from line 62 is being communicated to chamber 84, while on the other hand, chamber 86 has been vented to the atmosphere via line 70 and 74. Once solenoid valve shifts the 4-way valve 68, air pressure will be channeled into chamber 86 via line 70; the air pressure in chamber 84 will be vented to the atmosphere via line 66. This will cause a pressure differential in the cylinder 82, which will in turn cause the piston 78 and shaft member 80 to move upwards, thereby causing a reciprocating movement of the walking beam 46.

The horsehead 44 has connected thereto cable means 92, with the surface sucker rod means 90 being securely fastened to an adapter 94, which in turn is connected to the polished rod 22. The surface sucker rod means 90 cooperation with the cable means 92 and horsehead 44 is known as a double bridle arrangement as will be appreciated by those of ordinary skill in the art. Thus, as the pneumatic actuator causes reciprocal movement of the walking beam 46, the longitudinal movement is imparted to the sucker rod string 18 through the polish rod 22, which is connected to the cable means 90. It should be noted that a complete cycle of the air pressure in the cylinders 84,86 is required for the downhole pump 9.

Referring again to FIG. 2, the wellbore 2 will have disposed therein liquid level sensing means, seen generally at 20. In the preferred embodiment, the liquid level sensing means 96 will be a ¼" bubbler tube. However, it should be understood that other suitable apparatus for determining the level of a fluid column in a wellbore could also be employed, such as acoustic methods. The purpose of the bubbler tube is to determine the head of hydrostatic pressure of the underground water. The bubbler tube emits a small quantity of air at a constant rate of pressure. Once the tube 20 is placed within the wellbore, the fluid level in the casing will cause a back pressure in the tube equal to the height of the surrounding fluid, and the effect of the back pressure is measured in inches of water. The bubbler tube 96 is commercially available and can be purchased from Dwyer Instruments.

The bubbler tube 20 of the present invention will extend from a depth which is neighboring the well screen 6 depth which is adjacent the underground aquifer 4, to the surface. Once at the surface, the bubbler tube 20 is connected to a stroke pump level switch means 98 which is used to determine the hydrostatic pressure of the bubbler tube and convert the pressure into an electrical signal once the pressure exceeds a predetermined threshold. The corresponding pressure data will then be transmitted to the programmable logic controller 100, which in the preferred embodiment is a Siemens TI Model 545 Programmable Logic Controller. Generally, the predetermined threshold pressure will correspond to the level of fluid in the wellbore which the operator wishes for the pumping unit to pump fluid.

The programmable logic controller 100, also known as the programmable processing means, is used for converting the signal received from the stroke pump level switch to digital, computer readable signal, storing the data, and then comparing the data of the recovery well with other pre-programmed functions. Once the threshold pressure has been surpassed and the signal sent to the processor 100, the processing means generates an output signal which will be received by the solenoid valve 88.

The bubbler tube 96 can also have attached thereto a high level switch 102 which is also used to determine the level of the fluid in the wellbore; however, the switch 102 will activate only once a predetermined high level in the wellbore has been reached. This level is generally set a few feet above the top of the downhole pump 9. Once the high level has been reached, the high level switch 102 will generate a signal which will be sent to the processing means 100. The processing means will convert the signal to computer readable form, store the data, and then interpret the data, and then activate an alarm for the operator.

OPERATION

Figure 3:
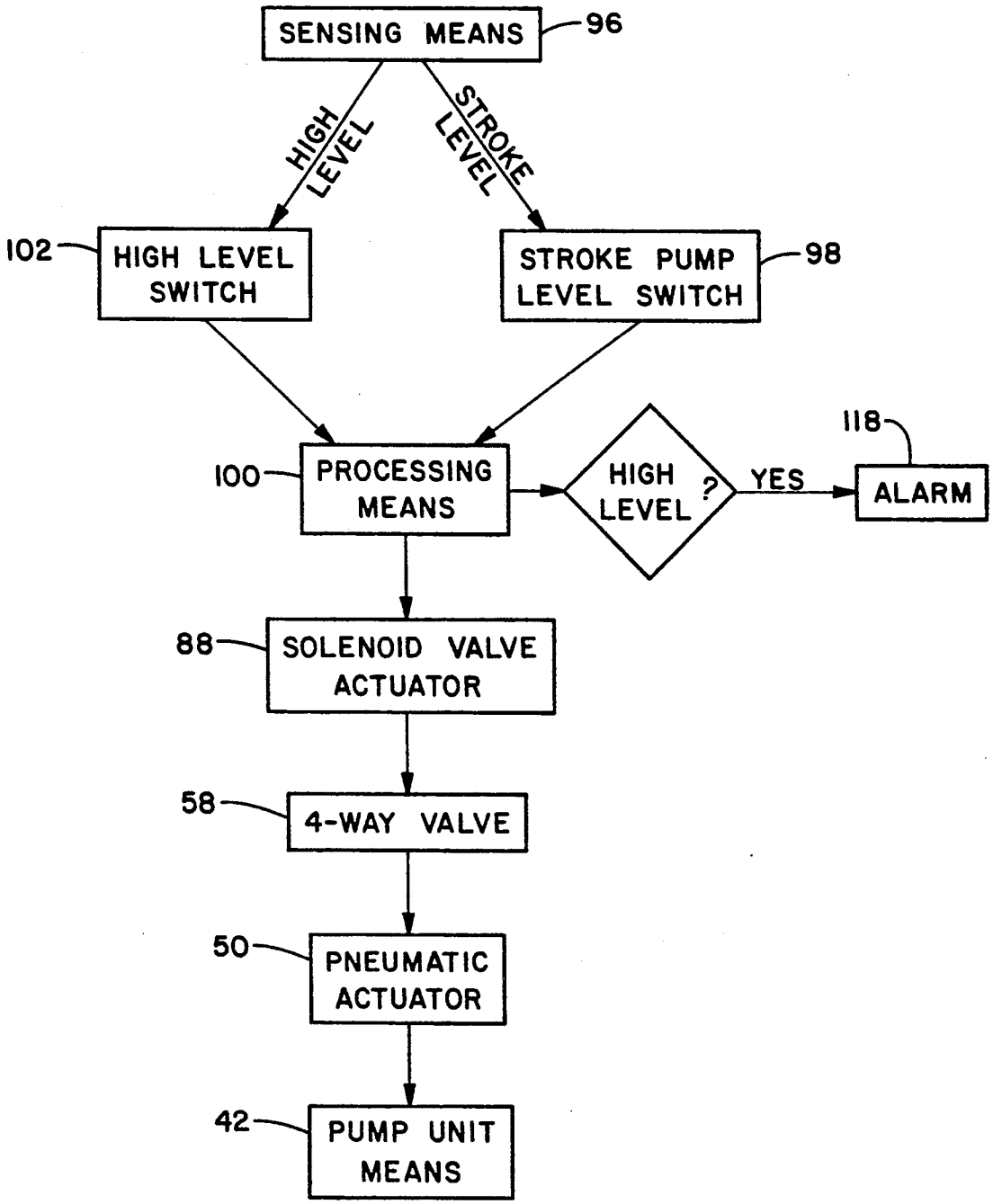
FIG. 3 is a block diagram of the environmental recovery system.

Referring to FIG. 3, the sequential method of the present invention is presented. The fluid from the underground formation 4 will naturally drain into the wellbore 2. The sensing means 96 will constantly sense the level in the wellbore 2. Once a predetermined level 97, which in the preferred embodiment will be a few inches above the top of the down hole pump 9, has been reached, the stroke pump level switch 98 will in turn signal the processing means 100.

The processing means 100 will receive this signal, and then will store the data, as well as generating an output signal to the solenoid valve actuator 88. The solenoid valve actuator, in turn, will send a signal to the 4-way valve 58 which will cause the air to enter into one of the cylinder chambers 84, 86, thereby causing the walking beam 46 to stroke.

In the case of a high level in the wellbore 2, the sensing means 96 will detect the increase in the hydrostatic head of pressure. The high level switch 102 will have built into it a predetermined pressure setting wherein anything above that point is considered "high", and corresponds to a predetermined level 103 in the wellbore 2. If the pressure, sensed by the sensing means 96, is above this assigned level, the high level switch will then send a signal to the processing means 100 which will in turn activate an alarm.

Figure 4:
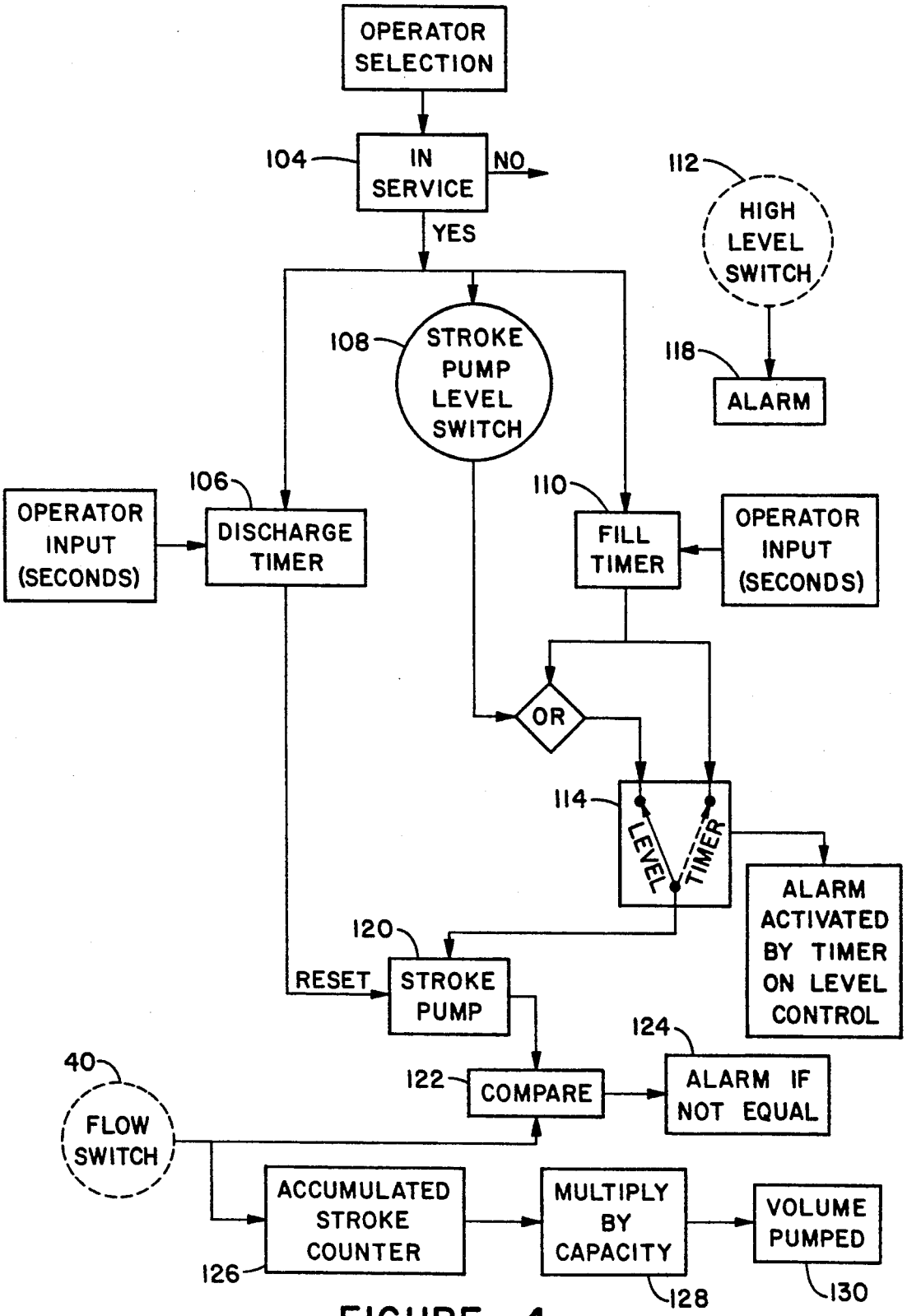
FIG. 4 is a flow chart of the logic of the components of the environmental recovery system.

A more detailed view of the logic of the processing means is seen in FIG. 4. Each of the wells of the recovery system will have an individual in-service controller 104 which will connect or disconnect that particular well with the system's network. The operator will select which wells will be connected to the network. If the operator chooses not to connect that particular well to the network, then the pump will not stroke.

If the in-service controller 104 has been selected, then the well is connected to the system's network which will provide for four logic components: the discharge timer 106, the stroke pump level switch 108, the fill timer 110, and the high level switch 112. Each of these logic components will now be explained.

The liquid level in the wellbore increases until it reaches the actuation point of the "stroke pump" level switch as heretofore described. At this point, the stroke pump switch is actuated, and through the PLC logic, sends a signal to the 4-way solenoid valve causing the pneumatic cylinder to stroke the piston in the pump cylinder. If the level in the well remains above the stroke pump level switch, then the PLC will stroke the pump constantly.

The time of this stroke is determined by the discharge timer 106. The purpose of the discharge timer is to ensure that the pumping unit means 42 completes a complete cycle. In other words, the air pressure is forced into chamber 84, causing the piston 78 to travel downward within cylinder 82, and then the air pressure in chamber 84 is vented to the atmosphere, and next air is forced into the chamber 86, thereby forcing the piston in an upward direction, completing the cycle.

The pump unit means 42 should remove enough liquid from the wellbore 2 to cause the stroke pump level switch to go off, therefore, causing the PLC to wait until the level in the wellbore 2 is re-established above the pump cylinder before it strokes the pump again. Thus, as FIG. 4 indicates, the discharge timer will reset with the stroke of the pump.

While the PLC is waiting for the well to fill, the fill timer 110 is timing down. The operator determines before hand a set amount of time which he desires the pump to stroke if the stroke pump level switch does not activate. If the timer 110 times out before the stroke pump level switch 108 actuates, then the PLC, as indicated in FIG. 4 in the control mode selector 114, will stroke the pumping unit means 42, as well as alert the operator, as shown in the route of the "or gate" 116, that this has happened.

In addition to the fill timer 110, there is also the high level switch 112. This switch will activate and sound an alarm 118 for the operator through the PLC if the level in the well reaches its actuation point a few feet above the top of the pump.

As seen in the stroke pump command 120, the appropriate signals have been sent to the pumping unit means 42; therefore, a slug of fluid from the wellbore 2 should have been pumped to the surface which in turn would have been measured by the flow switch 40. The processor means 100, as shown in the FIG. 4, will compare 122 the output from the flow switch, and the stroke pump 120, and if there is a discrepancy, such as no flow, an alarm 124 will notify the operator.

The processor means 100 may contain an accumulator counter 126 which will count the number of times the pumping unit 40 strokes. This will then by multiplied by the capacity of the pump as shown in box 128, which will render the volume of liquid pumped 130. This will render further checks and balances that the system is functioning properly.

Changes and modifications in the specifically described embodiments can be carried out without departing from the scope of the invention which is intended to be limited only by the scope of the appended claims.

I claim:

1. An apparatus for recovering underground liquids from a contaminated permeable strata in a wellbore, comprising:

pumping unit means for pumping the contaminated underground liquids form the wellbore;

pneumatic actuator means, operatively connected to said pumping unit means, for pneumatically actuating said pumping unit means;

liquid level sensing means, disposed within said wellbore, for sensing the liquid level within the wellbore;

a stroke pump level switch means, operatively connected with said liquid level sensing means, for generating a signal once a pre-determined threshold fluid level has been surpassed by the contaminated liquid in the wellbore; and programmable processing means for processing the stroke pump level switch means signal including fill timer means signal for measuring the length of time from each successive signal generated by said stroke pump level switch means, said programmable processing means including storage means for storing said signals, interpreting means for interpreting said signal, and generating an output signal in response to said signal from said high level switch and said fill timer means.

2. The apparatus of claim 1, wherein said pumping unit means includes:

a downhole pump;

a sucker rod attached to said downhole pump, said downhole pump and sucker rod being disposed within the wellbore;

a polished rod threadedly connected to said sucker rod; and a surface pumping unit, said pumping unit being connected to said polished rod so that said pumping unit imparts reciprocating motion to the sucker rod.

3. The apparatus of claim 2, wherein said liquid level sensing means includes:

a bubbler tube connected to said stroke pump level switch means, said bubbler tube being disposed within the wellbore and being sensitive to the hydrostatic pressure within the wellbore so that as the liquid level rises to the predetermined level within the wellbore, the change in hydrostatic pressure is effected in the bubbler tube and wherein said bubbler tube extends from a depth which is adjacent the contaminated formation to the surface.

4. The apparatus of claim 3, further comprising:

high level switch means, operatively connected with said bubbler tube, for generating a signal once a pre-determined high level hydrostatic pressure has been surpassed by the liquid in the wellbore.

5. The apparatus of claim 3, wherein said pneumatic actuator means comprises:

an air pressure source;

a solenoid valve, connected to said pumping unit and operatively associated with said air pressure source, said solenoid valve being responsive to the output signal of said programmable processing means; and a pneumatic cylinder, said pneumatic cylinder being responsive to said pneumatic controller valve, said pneumatic cylinder having a power piston therein forming a first and second chamber and wherein said solenoid valve cycles the air pressure form said first chamber to said second chamber so that said piston travels longitudinally in said pneumatic cylinder.

6. The apparatus of claim 3, further comprising:

a flow line connected to said polished rod, and wherein said liquid from said wellbore flows from said polished rod into the flow line;

flow switch means, operatively connected to said flow line, for measuring the rate of flow in said flow line and for generating a representative signal thereto; and wherein, said processing means further comprises means for storing the representative signal from said flow switch means.

7. A method of recovering contaminated subterranean fluids from a wellbore utilizing a pumping unit assembly, wherein the pumping unit assembly contains a downhole pump means for pumping the contaminated fluids to the surface, sensing means of sensing the hydrostatic head of pressure within the wellbore, means for generating a signal representative of the hydrostatic pressure sensed by the sensing means, processor means for storing and interpreting the signals received from the generating means, surface pump unit means for imparting reciprocating movement to the downhole pump to stroke, and pneumatic actuator means for pneumatically actuating reciprocating movement of the surface pump unit means, the method comprising the steps of:

a. flowing the contaminated subterranean fluids into the wellbore;

b. sensing the level of fluid in the wellbore;

c. determining when the level of fluid in the wellbore surpasses a predetermined threshold level;

d. presetting a fill timer means for setting the desired maximum amount of time for a pumping cycle of the pneumatically controlled pumping unit to pump the contaminated fluid from the wellbore wherein said maximum amount of time to pump corresponds to a normal discharge cycle;

e. generating a signal in response to the level surpassing the threshold pressure level;

f. transmitting and storing the signal in a programmable processing means;

g. comparing the length of time from the transmission of the signal due to surpassing the predetermined threshold level and the time remaining in the fill timer means;

h. activating the pneumatic controlled pumping unit to cause the pumping unit to pump the contaminated fluid from the wellbore whenever the length of time between the pumping cycle exceeds the length of time of said preset fill time means; and i. activating the pneumatic pumping unit to cause the pumping unit to pump the fluid from the wellbore in response to the level surpassing the threshold pressure level when the time between the pumping cycle of the pumping unit is less than the time of said preset fill time.

8. The method of claim 7, further comprising the steps of:

repeating steps a–i until the contaminated fluid no longer flows into the wellbore.

9. The method of claim 7, wherein after the step of determining when the level of fluid in the wellbore surpasses a predetermined threshold, the method further includes the steps of:

g. determining when the level of fluid in the wellbore surpasses a second predetermined threshold corresponding to a high level of fluid in the wellbore;

h. generating a signal in response to the level surpassing the high level threshold;

i. transmitting and storing the signal in the programmable processing means j. activating an alarm in order to warn an operator of the high level of fluid.

10. The method of claim 7, wherein a plurality of pumping units are associated with a plurality of wellbores intersecting contaminated aquifers, and wherein said plurality of pumping units are connected to the programmable processing means.

11. An assembly for collecting contaminated fluids from a subterranean zone in a wellbore to a surface location, the assembly comprising:

downhole pump means, disposed within said wellbore, for pumping the contaminated fluids to the surface;

pneumatic sensing means, disposed within the annulus area of the wellbore, for sensing the hydrostatic head of pressure within the wellbore;

means for generating a signal representative of the hydrostatic pressure sensed by the sensing means;

processing means, operatively associated with the sensing means, for storing and interpreting the signals received from the generating means, wherein said processing means contains a fill timer means, operatively associated therewith, for measuring a minimum amount of time between a stroke of said downhole pump, and control mode selector means for causing said downhole pump to stroke;

surface pump unit means, operatively associated with the processing means and the downhole pump means, for imparting reciprocating movement to the downhole pump means; and pneumatic actuator means, operatively associated with said surface pump unit means, for pneumatically actuating reciprocating movement of said surface pump unit means.

12. The assembly of claim 11, wherein said sensing means comprises:

a bubbler tube, said bubbler tube having a first end and a second end, with said first end being disposed within said wellbore, and said second end being disposed at the surface location; and pressure transducer means, operatively associated with the second end of the bubbler tube, for converting the hydrostatic head of pressure into an electrical signal.

13. The assembly of claim 12, wherein the surface pump unit means includes:

a walking beam having a first end and a second end;

a horsehead attached to the second end of said beam; and cable means, secured to said horsehead, for imparting the reciprocating movement to the downhole pump means.

14. The assembly of claim 13, wherein said pneumatic actuator means includes:

a solenoid valve responsive to said processor means;

a pneumatic controller valve responsive to said solenoid valve, said controller valve having a first position, second position, third position, and fourth position;

an air source means for supplying air to said pneumatic controller valve.

15. The assembly of claim 14, wherein said pneumatic actuator means further comprises:

a pneumatic cylinder, said pneumatic cylinder being responsive to said pneumatic controller valve, said pneumatic cylinder having a base end attached to the surface and a top end attached to the first end of the walking beam.

16. The assembly of claim 15, wherein said pneumatic cylinder comprises:

a cylindrical body, said body having a first and second passageway defined therein;

a power piston, disposed within said body, said power piston having attached thereto a telescopic shaft member;

and wherein said power piston defines a first chamber and a second chamber within said cylindrical body, and wherein said first chamber is communicated with the first passageway and said second chamber is communicated with the second passageway;

and wherein said telescopic shaft member is attached to the first end of the waking beam.

17. The assembly of claim 12, wherein said downhole pump means includes:

sucker rod means, disposed within the wellbore and connected to said downhole pump means, for pumping fluid in the wellbore; and a polished rod threadedly connected to said sucker rod.

18. The assembly of claim 12, further comprising:

a flow line, said flow line being operatively associated with said polished rod so that as fluid is pumped from the wellbore, the fluid will flow into said flow line;

measuring means, associated with said flow line, for measuring the volume of the fluid produce through said flow line.

19. The assembly of claim 18, said processing means further comprising:

pump stroke means for determine the capacity of volume pumped from the wellbore; and comparing means for comparing the capacity of volume pumped by the pump means as measured by the pump stroke means and the volume of fluid produced through said flow line as measured by the measuring means.

20. The assembly of claim 12 further comprising:

high level sensing means for sensing a high level within the wellbore; and alarm means for sounding a alarm if a high level within the wellbore is sensed by the high level sensing means.

* * * * *